United States Patent [19]

Lombness

[11] Patent Number: 4,989,415

[45] Date of Patent: Feb. 5, 1991

[54] COOLING HOLDER FOR BEVERAGE CONTAINER

[76] Inventor: Jeffrey G. Lombness, 7352 N. 38th St., Milwaukee, Wis. 53209

[21] Appl. No.: 390,196

[22] Filed: Aug. 7, 1989

[51] Int. Cl.[5] ..... F25D 3/08

[52] U.S. Cl. ..... 62/372; 62/457.4

[58] Field of Search ..... 62/457.4, 430, 372

[56] References Cited

U.S. PATENT DOCUMENTS

| | | | |
|---|---|---|---|
| 3,302,427 | 2/1967 | Stoner et al. | 62/457.4 |
| 3,703,816 | 11/1972 | Weathers | 62/457.4 |
| 4,383,422 | 5/1983 | Gordon et al. | 62/457.4 |
| 4,485,636 | 12/1984 | Hilado | 62/430 |
| 4,577,474 | 3/1986 | Peterson | 62/457.4 |
| 4,745,776 | 5/1988 | Clark | 62/457.4 |

*Primary Examiner*—Lloyd L. King

*Attorney, Agent, or Firm*—Fuller, Ryan & Hohenfeldt

[57] ABSTRACT

A holder for keeping a beverage container, whether can or bottle, cold. The holder includes a cup-shaped base, of an inside diameter sufficient to accommodate the outside diameter of the beverage container. A cylindrical upper portion is provided, having both ends open, one end being snap connectable to the base, and an inside diameter which matches the outside diameter of the beverage container. The base contains a coolant or refrigerant container having an outside diameter corresponding to the inside diameter of the base. The height of the refrigerant container corresponds to the inside height of the base. The top surface of the refrigerant container is extremely flexible so as to conform closely to the bottom surface of the beverage container when the container is placed into the holder. The length of the top portion is substantially the length of the container. The top portion and the base are provided with a hard outer surface, and lined with a softer insulating material. The top portion includes a longitudinal channel formed along one side thereof, and a handle slidably inserted into the channel, to facilitate the user holding the holder. A filler piece may be provided, which conforms to the shape of the channel, for filling the channel when the user does not desire to use the handle with the holder.

15 Claims, 1 Drawing Sheet

COOLING HOLDER FOR BEVERAGE CONTAINER

BACKGROUND OF THE INVENTION

This invention relates to portable insulated holders for individual beverage containers, and in particular to such insulated holders which contain refrigerant to keep the beverage in the container cooler longer.

It is a common problem that beverages, best taken cold, do not seem to stay cold enough long enough. Numerous patents have been devoted to the attempt to keep such beverages cooler or to keeping them cool longer. Several examples are referenced in Gordon, U.S. Pat. No. 4,383,422, and the Background of the Invention portion of that patent is incorporated herein by reference. The Gordon patent itself shows a holder for a beverage container, which holder includes a compartment or cartridge containing refrigerant. This refrigerant can be frozen or chilled to keep the beverage in the container cool longer. The compartment or container, however, is disclosed to have a flat top which does not contact modern concave-bottom containers except around the edge periphery, so the transfer of energy required for efficient cooling is limited.

The Clark patent, U.S. Pat. No. 4,745,776, also shows a refrigerant element placed in the bottom of a beverage can holder. The refrigerant element there shown includes a raised middle top portion designed to accommodate to an extent a recess conventionally formed in the bottom of the beverage can. The top portion of the refrigerant element, however, is disclosed to be rigid, and the invention is directed to working with two types of cans only. The design is thus limited as to the types of containers to which it can be effectively applied.

This invention relates to improvements to the apparatus described above and to solutions to the problems raised thereby.

SUMMARY OF THE INVENTION

This invention includes a holder for keeping a beverage container, whether can or bottle, cold. The holder includes a hollow, generally cup-shaped base, of an inside diameter sufficient to accommodate the outside diameter of the beverage container. A hollow generally cylindrical upper portion is provided, having two ends, both open, one end being removably connectable to the base by a snap connecting means. A coolant or refrigerant container is positioned in the base, and has an outside diameter corresponding to the inside diameter of the base. The height of the refrigerant container corresponds to the inside height of the base. The top surface of the refrigerant container is extremely flexible so as to conform closely to the bottom surface of the beverage container when the container is placed into the holder. The length of the top portion is substantially the length of the container. The top portion and the base comprise a hard outer surface lined with a softer insulating material, the inside diameter of which insulating material corresponds to the outside diameter of the beverage container. A longitudinal channel is formed along one side of the top portion, and a handle slidably inserted into the channel, to facilitate the user holding the holder. A filler piece may be provided, which conforms to the shape of the channel, for filling the channel when the user does not desire to use the handle with the holder.

Other objects and advantages of the invention will become apparent hereinafter.

DESCRIPTION OF THE PREFERRED EMBODIMENT

Figure 1:
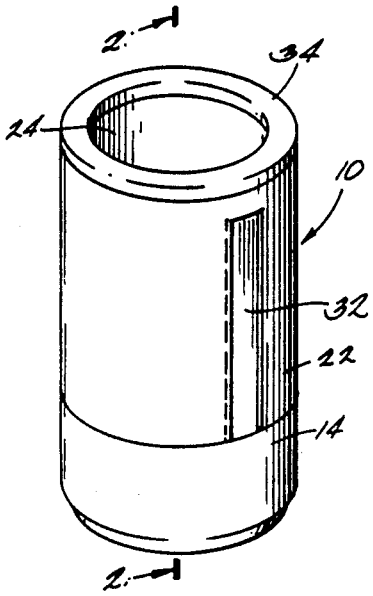
FIG. 1 is an isometric view of a holder for a beverage container constructed according to one embodiment of the invention.
Figure 3:
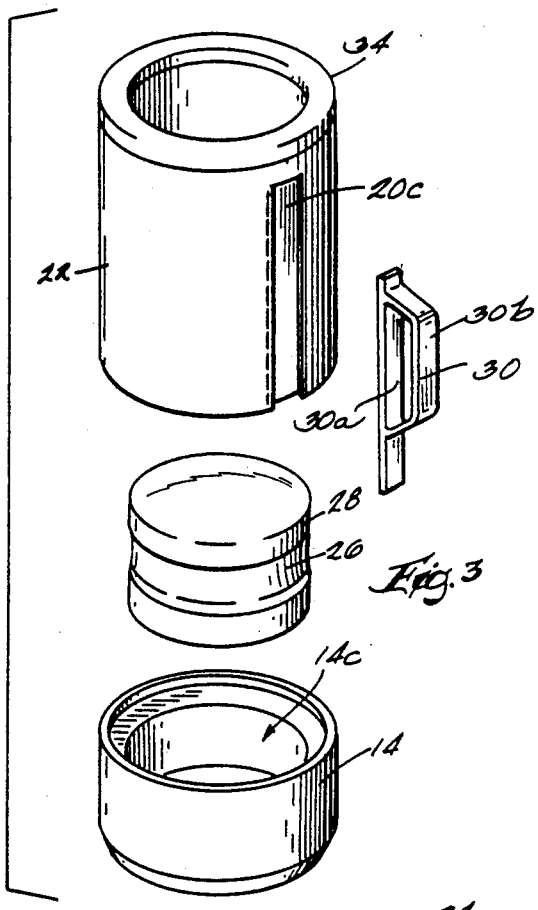
FIG. 3 is an exploded isometric view of the embodiment shown in FIG. 2.
Figure 2:
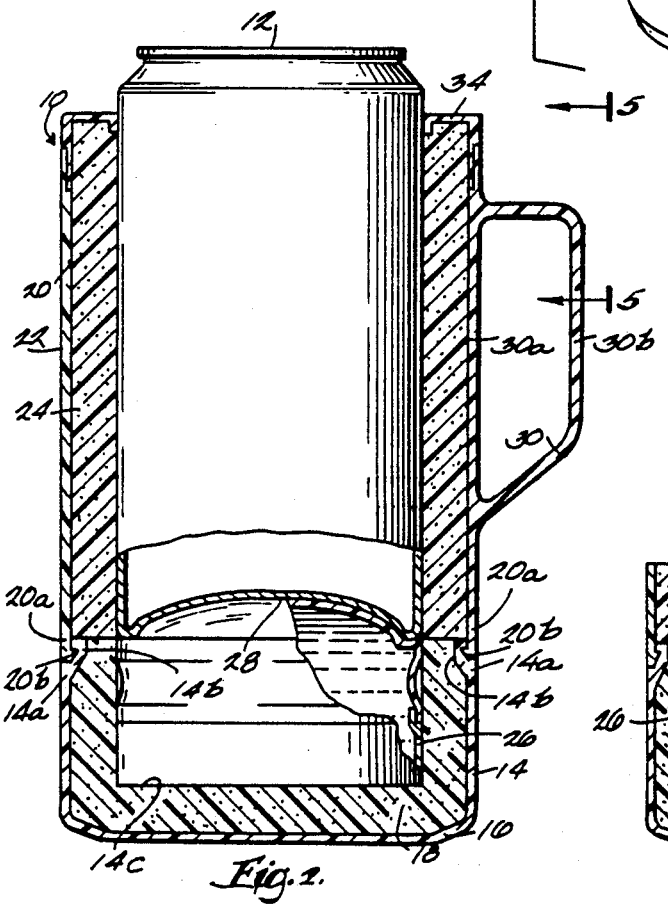
FIG. 2 is a cross sectional view of FIG. 1 taken generally along line 2—2 thereof, with a handle installed and a beverage container inserted therein.
Figure 5:
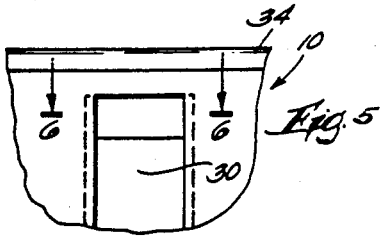
FIG. 5 is a side elevational view of the embodiment shown in FIG. 2, taken generally along line 5—5 thereof.
Figure 6:
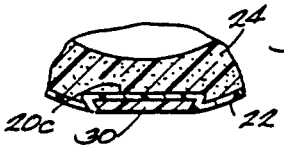
FIG. 6 is a cross sectional view of FIG. 5, taken generally along line 6—6 thereof.

Referring now to FIGS. 1, 2 and 3, there is shown a holder 10 for a single beverage container 12 (FIG. 2). In the embodiment there shown, the holder 10 includes a base 14, which is hollow and generally cylindrical and cup-shaped. As can be seen best in FIG. 2, in the preferred embodiment the base 14 is constructed of an outer shell 16 which is of a relatively hard material such as polyvinyl chloride. The shell 16 is lined with a relatively softer insulative layer 18, such as air-injected polyurethane. This latter material is chosen because it has better insulative qualities than polystyrene. A number of different insulative layers 18 may be supplied with the holder 10 so as to facilitate the accommodation of beverage containers 12 having differing outside diameters.

The holder 10 further includes a top portion 20, which is generally cylindrical in shape, and is open at both ends. Similar to the base 14, the top portion 20 is constructed of a hard outer shell 22 and a softer insulative inner layer 24. The respective materials are the same as those of the base 14. The inside diameter of the top portion 20 is sized so as to approximately match the outside diameter of the particular beverage container 12. Because of the softness of the inner layer 24, some flexibility in the outside diameter of the container 12 will be accommodated, but again, similar to inner layer 18, different thicknesses of inner layer 24 may be provided to further accommodate beverage containers 12 having differing outside diameters. These may be interchanged by sliding one inner layer 24 out axially, and inserting another the same way.

The inside and outside diameters of the base 14 are sized to match the respective diameters of the top portion 20, so that the top portion can be assembled to the base. To that end, the bottom edge **20*a* of the top portion 20 and the upper edge 14*a* of base 14 are provided with means for connecting the two together. In the preferred embodiment, these connection means include an annular groove 14*b* about the outside surface of upper edge 14*a* of the base 14 and a corresponding annular rib 20*b* projecting inward about the bottom edge 20*a* of the top portion 20. The rib 20*b* and the groove 14*b* are sized relative to each other so that the top portion 20 and the base 14** respectively must flex to a certain limited extent to permit the rib to snap into the groove, thus affixing the two tightly but removably together.

Figure 4:
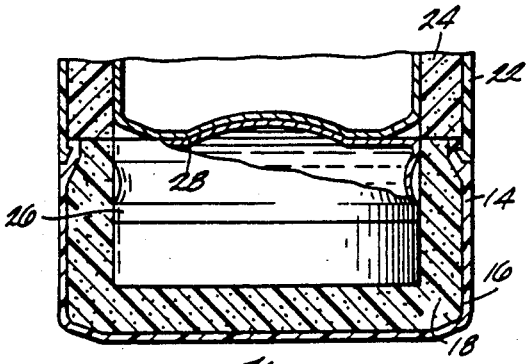
FIG. 4 is a cross sectional view, similar to FIG. 2, having a different beverage container inserted therein.

One of the objects of the invention is to provide a holder for a beverage container wherein only a small portion of the entire holder, such as the refrigerant in the base, may be placed in a refrigerator or freezer in preparation of use, so that less space is taken up thereby. It is especially useful to be able to put a small portion of the holder in the refrigerator or freezer without requiring removal of the refrigerant container therefrom, because of the well-known problems related to handling the refrigerant container or any other item when cold, and the problems of removal and insertion of the refrigerant container into a holder. To this end, referring now to FIGS. 2, 3 and 4, as indicated above, the base 14 is cup-shaped. This cup shape includes a hollow area 14*c* formed therein, the diameter of which approximately matches the inside diameter of top portion 20. Into the hollow 14*c* is placed a container 26 of refrigerant. The refrigerant in the container 26 is of a conventional type, highly viscous or gelatinous in nature, such as a high viscosity aqueous solution of methyl cellulose or glycerine, or a glycol-type gelatinous freezable substance. To prepare the holder 10 for use, then, the combination of the refrigerant container 26 assembled into the base 14, is placed in a refrigerator or freezer and chilled. Hence much less space is taken up in the refrigerator or freezer as compared to prior art holders. These holders generally have non-removable refrigerant containers, which require that the entire holder, or a much larger portion of the holder, be placed in the refrigerator or freezer to prepare it for use, thus reducing the number of such holders which could be placed in limited space in the freezer or refrigerator. Alternatively, they require direct handling of the refrigerant container itself, and removal of the refrigerant container from the holder.

Another object of the invention is to provide improved cooling to the beverage container when installed into the holder 10. Therefore the container 26 includes a cover 28 which is highly flexible, even when cold, such as being made of a light, flexible plastic. Then, as shown best in FIGS. 2 and 4, when the beverage container 12 is installed into the holder 10, the cover 28 acts as a pillow and conforms very closely to the bottom surface of the beverage container, providing highly efficient energy transfer and cooling of the beverage inside the container. This conformation of the cover 28 to the bottom of the beverage container 12 is achieved generally regardless of the particular shape of the bottom of the beverage container itself. This effect can be seen by comparing FIG. 2 to FIG. 4, since the two figures show different shapes of beverage container bottoms, but equally good conformation of the cover 28 to the beverage container bottom. Such close conformation of the cover 28 to the bottom of the beverage container 12, and the correspondingly efficient energy transfer regardless of the particular shape of the bottom of the beverage container, is not possible with the rigid refrigerant container tops of the prior art.

The present invention further permits customization of the appearance and usage of the holder 10, by permitting the application of a handle 30 to the holder, without requiring use of the handle to achieve a complete aesthetic look. Referring now to FIGS. 1, 3, 5 and 6, the top portion 20 includes a channel 20*c* which, as shown in FIG. 3, is formed longitudinally along the majority of the length of one side of top portion 20. To facilitate assembly of the handle to the top portion, the channel 20*c* extends downward to the bottom edge 20*a* of the top portion. As shown best in FIG. 6, in the most preferred embodiment, the channel 20*c* is formed with dovetail sides, to retain the handle 30 tightly. The handle 30 includes an insertable portion 30*a* which just fits into the channel 20*c*, and a grippable portion 30*b* which is integrally formed with the insertable portion and projects outward away therefrom in any suitable configuration. The length of the insertable portion 30*a* matches the length of the channel 20*c*. Since the channel 20*c* extends to the bottom edge 20*b* of the top portion 20, the handle 30 is maintained in the channel by the base 14, after attachment of the base to the top portion. The channel 20*c* performs the additional function of a guide or keyway for sliding different inner liners 24 into the top portion 20, to accommodate different outside diameters of beverage containers 12.

The preferred embodiment of the invention includes a channel filler 32, shown in FIG. 1, in case the user prefers a holder without a handle. The channel filler 32 is identical to the insertable portion 30*a* of handle 30, without any grippable portion 30*b*. Thus is provided a very pleasing appearance by the holder 10, whether or not it is desired to have use of a handle.

A separate cover piece 34 may be provided, and attached by friction fit or otherwise, to the top end of the top portion 20 so as to facilitate manufacture of the top portion, and to cover and provide structural support to the inner layer 24.

While the apparatus hereinbefore described is effectively adapted to fulfill the aforesaid objects, it is to be understood that the invention is not intended to be limited to the specific preferred embodiments of cooling holder for beverage container set forth above. Rather, it is to be taken as including all reasonable equivalents within the scope of the following claims.

I claim:

1. A holder for keeping a beverage container cold, said container having a generally cylindrical shape of a predetermined outside diameter and a bottom surface, said holder comprising:

a hollow, generally cup-shaped base, of an inside diameter sufficient to accommodate the outside diameter of said beverage container; and a hollow generally cylindrical upper portion having two ends, one end being removably connectable to said base, said upper portion having an inside diameter matching the outside diameter of said beverage container and having both ends open;

said base containing coolant, said coolant having a top surface which is extremely flexible so as to substantially conform to said bottom surface of said beverage container when placed into the holder, and maintain substantially continuous contact with the majority of said bottom surface, regardless of the shape of said bottom surface.

2. A holder as recited in claim 1 further comprising a coolant container having an outside diameter corresponding to said inside diameter of said base, having a height substantially coextensive with the inside height of said base, and having a top surface which is extremely flexible so as to conform to said bottom surface of said beverage container when placed into the holder, and maintain substantially uninterrupted contact with the majority of said bottom surface, regardless of the shape of said bottom surface.

3. A holder as recited in claim 1 wherein the length of said top portion is substantially the length of the container.

4. A holder as recited in claim 1 wherein said top portion connects to said base by means of a snap connecting means.

5. A holder as recited in claim 1 wherein said top portion and said base comprise a hard outer surface lined with a softer insulating material, said insulating material having an inside diameter which corresponds to the outside diameter of said beverage container, and handle means removable connected to said top portion.

6. A holder as recited in claim 1 wherein said top portion includes a longitudinal channel formed along one side thereof and extending from the bottom edge of the top portion upward to short of the top edge, and a handle slidably inserted into said channel and locked therein by said base, after attachment of said base to said top portion, to facilitate the user holding said holder.

7. A holder as recited in claim 6 further comprising a filler piece which conforms to the shape of said channel, for filling said channel when said handle is not installed therein.

8. A holder as recited in claim 7 wherein said base has outside lower corners which are indented all the way around the perimeter thereof to simulate the appearance of a beverage can.

9. A holder for keeping a beverage container cold, said container having a generally cylindrical shape of a predetermined outside diameter and a bottom surface, said holder comprising:

a hollow, generally cup-shaped base, of an inside diameter sufficient to accommodate the outside diameter of said beverage container;

a hollow generally cylindrical upper portion having two ends, one end being removably connectable to said base, said upper portion having an inside diameter matching the outside diameter of said beverage container and having both ends open; and a coolant container having an outside diameter corresponding to said inside diameter of said base, having a height substantially coextensive with the inside height of said base, and having a top surface which is extremely flexible so as to substantially conform to said bottom surface of said beverage container when placed into the holder, and uniformly maintain contact with the majority of said bottom surface, substantially regardless of the shape of said bottom surface.

10. A holder as recited in claim 9 wherein said top portion connects to said base by means of a snap connecting means.

11. A holder as recited in claim 9 wherein said top portion and said base comprise a hard outer surface lined with a softer insulating material, said insulating material having an inside diameter which corresponds to the outside diameter of said beverage container, and handle means removably connected to said top portion.

12. A holder as recited in claim 9 wherein the length of said top portion is substantially the length of the container.

13. A holder as recited in claim 9 wherein said top portion includes a longitudinal channel formed along one side thereof and extending from the bottom edge of the top portion upward to short of the top edge, and a handle slidably inserted into said channel and locked therein by said base, after attachment of said base to said top portion, to facilitate the user holding said holder.

14. A holder as recited in claim 13 further comprising a filler piece which conforms to the shape of said channel, for filling said channel when said handle is not installed therein.

15. A holder as recited in claim 14 wherein said base has outside lower corners which are indented all the way around the perimeter thereof to simulate the appearance of a beverage can.

* * * * *